United States Patent [19]

Leck

[11] Patent Number: 4,505,526

[45] Date of Patent: Mar. 19, 1985

[54] DRAWER CATCHES

[76] Inventor: David G. Leck, 35 Park Rd., Westcliff-on-Sea, Essex, England

[21] Appl. No.: 353,592

[22] Filed: Mar. 1, 1982

[30] Foreign Application Priority Data

Mar. 6, 1981 [GB] United Kingdom ..... 8107046

[51] Int. Cl.[3] ..... A47B 88/00

[52] U.S. Cl. ..... 312/333; 16/82; 292/80; 292/244; 312/348

[58] Field of Search ..... 16/82, 49; 312/348, 312/333; 292/262, 128, 91, DIG. 14, DIG. 38, 244, 116, 80; 70/85

[56] References Cited

U.S. PATENT DOCUMENTS

| | | | |
|---|---|---|---|
| 84,032 | 11/1868 | Washburn | 292/91 |
| 297,118 | 4/1884 | Doolittle et al. | 292/128 |
| 363,008 | 5/1887 | Shaw | 292/116 |
| 1,943,946 | 1/1934 | Brainerd | 292/244 |
| 2,558,959 | 7/1951 | Jandus | 292/DIG. 14 |
| 3,287,045 | 11/1966 | Avery | 292/244 |
| 3,397,001 | 8/1968 | Friedman | 312/348 |
| 3,497,251 | 2/1970 | Bosland et al. | 292/262 |
| 3,850,463 | 11/1974 | Hawkins | 312/333 |
| 3,888,525 | 6/1975 | Kousens | 312/348 |
| 4,139,249 | 2/1979 | Hillman | 312/333 |

FOREIGN PATENT DOCUMENTS

| | | | |
|---|---|---|---|
| 2932123 | 2/1981 | Fed. Rep. of Germany | 312/333 |

*Primary Examiner*—William E. Lyddane
*Assistant Examiner*—Thomas A. Rendos
*Attorney, Agent, or Firm*—Murray Schaffer

[57] ABSTRACT

A catch means as described which when fitted to co-operating parts of a piece of furniture enable those co-operating parts to be moved apart by a small amount after which, following manipulation of the catch means, may be more fully moved apart.

The catch means is said to comprise a stop element and a hooked element the two elements being mountable on the parts of the piece of furniture. The hooked element comprises an elongate member having a first hook portion formed at one end thereof and at least one second hook portion formed along the length of it. The first hook portion of each of the said at least one second hook portions extend in different directions from the axis of the elongate member. The other end of the elongate members adapted for mounting on one of the parts of the piece of furniture in a number of different predetermined orientations enabling the stop means to engage one of the first and at least one second hook portions to prevent extended movement of the two parts by more than a predetermined amount corresponding to the orientation in which the hook member is mounted. In a preferred arrangement the hooked element is provided with two hooks facing in opposite directions.

11 Claims, 3 Drawing Figures

DRAWER CATCHES

DESCRIPTION

Figure 1:
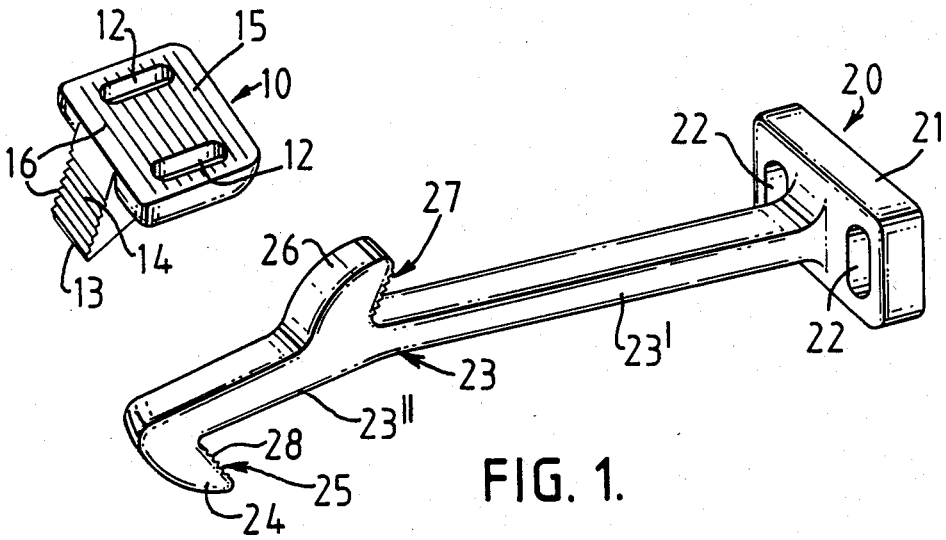

The invention concerns catches and particularly but not exclusively safety catches which prevent drawers, doors and the like being easily fully opened to enable access to be made, by infants, to potentially hazardous articles and materials stored therein.

Catches are known which enable a drawer or door to be partially opened and which then require further manipulation by an opener to enable the drawer to be fully opened. The purpose of such a catch is to prevent access to potentially dangerous articles and/or materials being made by infants who, it is assumed, will have neither the mental ability nor physical dexterity to both manipulate the catch into a releasing position and open the drawer or door on which the catch is operably mounted.

Many catches of this type provide a catch including a flexible element which, once the drawer or door has been partially opened, may be manually pushed by an opener, to a door or drawer releasing position and then held in that position whilst the door or drawer is fully opened.

One major difficulty found with such a catch arises when a drawer or door fitted with such a catch is located adjacent another drawer, door or other item of furniture; the partial opening of the drawer or door fitted with the catch may often be insufficient to permit ready access, of an adults finger for example, to a position at which one can manipulate and push the flexible element of the catch to a drawer or door releasing position.

Clearly one solution to this problem is to provide an arrangement in which the elongate flexible element is longer, but such a solution has the disadvantage that when such a catch is fitted to a drawer or door not in close proximity to another article of furniture the drawer or door fitted with the catch may be sufficiently openable for an infant to insert his wrist and arm in the partially opened drawer or door and so gain access to the content thereof.

Alternative proposals would be to provide a plurality of catches having different lengths of flexible elements or that the elongate flexible element of a single size catch be provided, at that end of it mounted on the drawer or door, with a spacer element in selected circumstances. Such proposals however add both to the cost and complexity of the catch and, perhaps more importantly, to the difficulty in fitting the catch.

An aim of the invention is the provision of a catch meeting or substantially alleviating the noted problems of the known catches and proposals for catches.

In accordance with the invention there is provided a catch comprising a stop element and a hooked element which elements are mountable on parts of a piece of furniture movable relative to one another and are when so mounted engageable one with the other to prevent extended relative movement of those parts, the hooked element comprising an elongate member having a first hook portion formed at one end thereof and at least one second hooked portion formed part way along the length thereof, the first hook portion and each of said at least one second hook portions extending in different directions from the axis of the elongate member, the other end of said elongate member being adapted for mounting on one of said parts in a number of differing predetermined orientations such as to enable the stop means to engage one of said first and at least one second hook portions to prevent extended movement of said two parts by more than a predetermined amount determined by the mounting orientation of the hooked element.

Preferably the hooked element and the stop means are made of a moulded plastics material, for example nylon.

One embodiment of the invention provides that the hooked element is formed with two hook portions on an extended elongate flexible part thereof, the hooked portions facing in mutually opposite directions.

Figure 3:
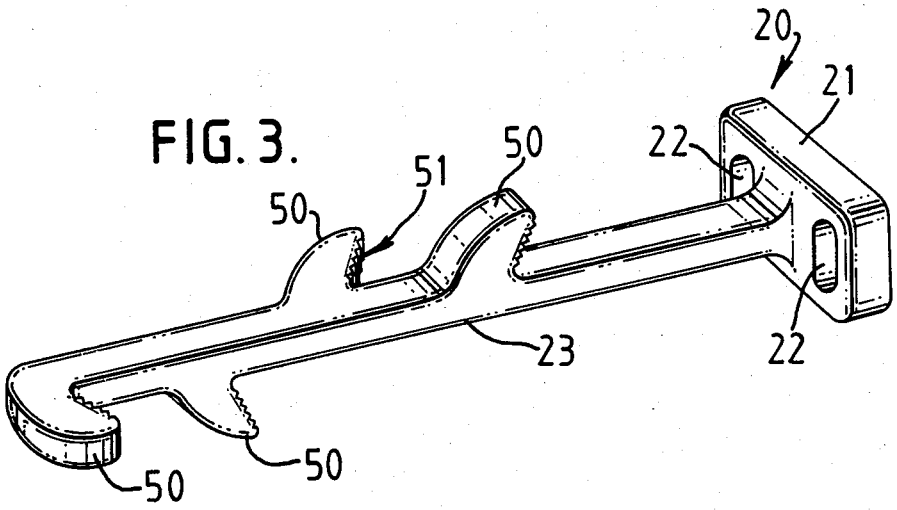
Figure 2:
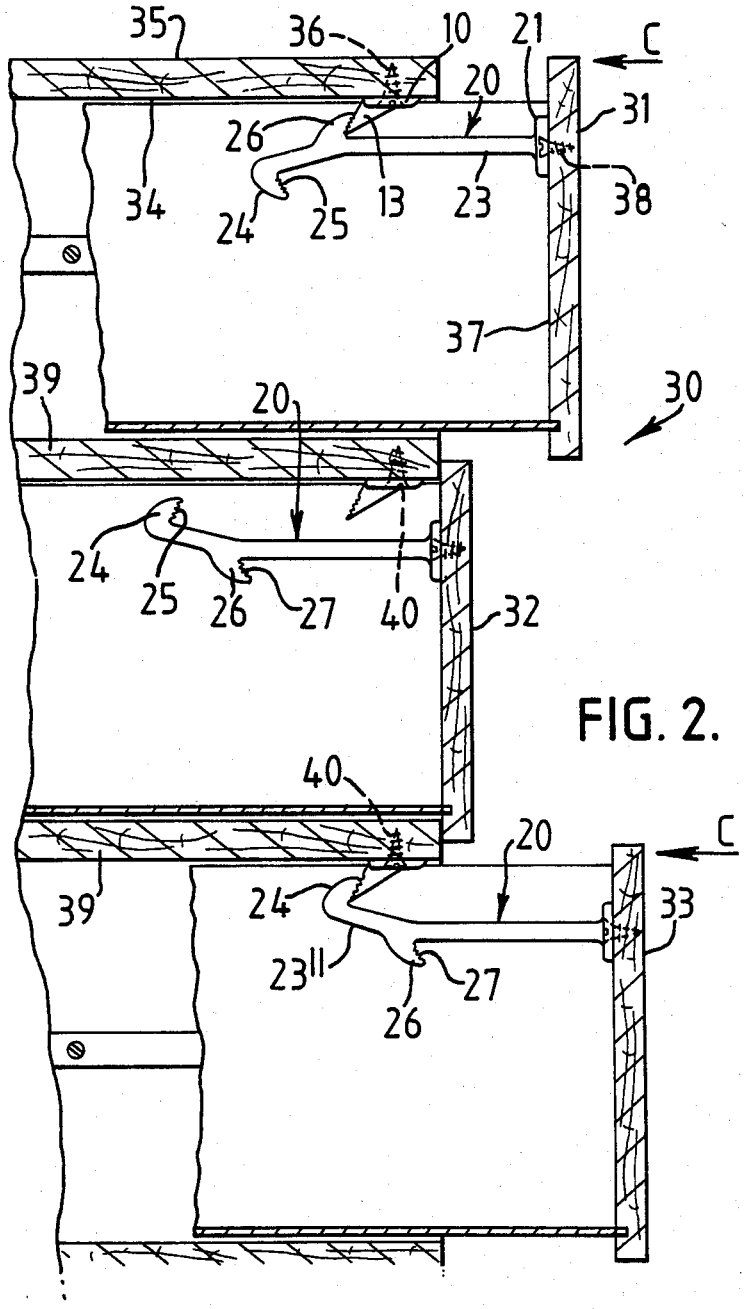

Embodiments of the invention will now be described with reference to the accompanying drawings in which:

FIG. 1 is a perspective view of two elements of the catch embodying the invention, FIG. 2 is a partially exposed side view of an article of furniture in which catches described with reference to FIG. 1 are fitted, and FIG. 3 is a perspective view of another form of catch embodying the invention.

The catch shown in FIG. 1 comprises a body 10 formed with apertures 12 through which screws (not shown in FIG. 1) may pass to fix the body to a piece of furniture. Body 10 includes a triangular tongue portion 13 having a stop face 14. Surface 15 of body 10 and the stop surface 14 may each be roughened, for example by the formation thereon of a series of ridges or serrations 16 whilst the body is being formed.

FIG. 1 also shows a hooked element 20 comprising a base 21 slotted at 22 to enable the passage of screws (not shown in FIG. 1) there-through to fix the element onto a piece of furniture on which the catch is to be mounted. Element 20 including a flexible elongate member 23 carried on base 21 and formed at the end thereof spaced from base 21 with the first hook 24 having a face 25 which can cooperate with stop face 14 of element 10. Part-way along the length of member 23 the element 20 is formed with a second hook 26 having a face 27, which face 27 also, in certain circumstances can engage the face 14 of element 10.

With advantage the faces 25 and 27 are provided with ridges or serrations 28 for cooperating with the ridges 16 on stop face 14.

The elements 10 and 20 are preferably formed by moulding from a flexible plastics material (for example nylon) which enables the elongate portion 23 of element 20 to be readily pushed away from the position which it normally adopts in use by the application pressure thereto by, for example an adults finger.

FIG. 2 shows a three-drawer cabinet 30 having drawers 31, 32 and 33. A stop element 10 such as shown in FIG. 1 is fixed to the undersurface 34 of the top element 35 of the furniture unit 30 by screws 36. A hooked element 20 is mounted on the rear surface 37 of the front of drawer 31 by screws 38. The elements 10 and 20 associated with the drawer 31 are so mounted that the hook 26 is uppermost and the elements 10 and 20 are aligned such that the face 27 engages with the face 14 of member 10 when the drawer 31 is partially opened. The catch provides that the drawer 31 is openable to the extent shown but cannot be opened further unless the drawer is closed slightly (that is to say pushed slightly in the direction of the arrow C) and the flexible element 23 depressed such that the face 27 is moved below—out of alignment with—the face 14 of element 10. Whilst holding the flexible element 23 in the depressed position the drawer 31 may be fully opened.

Drawers 32 and 33 have elements 20 mounted thereon as shown, that is to say with the element 20 rotated through an angle of 180° with respect to the position adopted by the element 20 attached to the drawer 31. It will be appreciated that if the elements 20 were positioned with the same orientation as that attached to the drawer 31 the space between the fronts of drawers 31 and 32 (or 32 and 33) when lower most drawer is opened as far as is enabled by the catch would be significantly less than that provided when the front of drawer 31 is partially opened between the drawer front 31 and the element 35.

The elements 20 are therefore mounted on the backs of the fronts of drawers 32 and 33 with their hooks 24 uppermost such the surfaces 25 are engageable with the faces 14 of the elements 10 attached as shown to structural members 39 within the drawer unit 30. The elements 10 are attached to the structural members 39 by screws 40.

With the arrangement described the gap between the drawers 31 and 32 (or 32 and 33) when a drawer 32 or 33 is opened, is considerably extended by an amount which is substantially equal to that shown existing between the drawer front 31 and element 35 in FIG. 2.

To fully open a drawer 32 or 33 the drawer (for example drawer 33) must be slightly closed—that is to say pushed in the direction of the arrow C and the flexible element depressed to move face 25 out of alignment with face 14. The drawer 33 may then be opened whilst the element 23 is held depressed by a person opening the drawer.

As noted above the elements 10 and 20 are preferably moulded from a plastics material such as nylon.

As described the element 20 is provided with two hooks 24 and 26 enabling the efficient use of the catch in two orientations namely with the drawer to which it is being fixed uppermost (the arrangement of drawer 31) or with a drawer to which it is being fixed below one or more similar drawers (the arragement of drawers 32 and 33) in FIG. 2. The spacing between the hooks 24 and 26 along the elongate element 23 is such as to take account of the average thickness of drawer fronts in use in furniture units produced today—say 20 mm.

With advantage the first portion 23' of member 20 running from the base 21 to the hook 26 diverges from the normal to the base 21 through a small angle (approximately 1 degree) to increase the height of the hook 26 above the base 21. The further extension 23'' of the member 20 from the hook 26 to the hook 24 preferably runs at an angle of 16° to the axis of the portion 23'. This means that the hook 24, when the member 20 is attached as shown to the drawer fronts 32 and 33 of FIG. 2 lies slightly above the normal to the base 21 of the member 20. Within the scope of the invention it is possible that further hook members may be provided on the flexible element at varying distances from the base 16 at mutually different orientations to provide that the hook member 20 is applicable for use in a variety of different situations.

A modified form of hook member usable in such an arrangement is as shown in FIG. 3. In the arrangement of FIG. 3 both parts of the hook member corresponding to the hook member shown in FIGS. 1 and 2 are given the same reference numerals. With the arrangement of FIG. 3 the hook member 20 is provided at four locations at predetermined spacings along the length of the flexible member 23 for hook members 50. Each hook member 50 having a face 51 for cooperating with the stop face 14 of the element 10. With the arrangement of FIG. 3 the hook member 20 may be positioned in any one of four different orientations to enable a drawer to which it is attached to be opened partially by any one of four different mounts enabling the insertion of a users finger through the gap so proposed to push down the elongate member 23 and enable the further opening of the drawer.

Although specific description of this invention has been made with reference to drawers it will be appreciated that the elements 10 and 20 may be located on parts of other pieces of furniture movable relative to one another and which it is wished to secure, for example the elements may be fitted to sliding and/or hinged doors, windows and the like.

What is claimed is:

1. Catch means comprising a hooked element mountable on a part of a piece of furniture movable relative to another part of the piece of furniture and which is, when so mounted, engageable with a single fixed stop body on the other part to prevent extended relative movement of the two parts, the hooked element comprising an elongate flexible member, one end of which is adapted for mounting on a part of a piece of furniture, a first hook portion formed on said elongate flexible member and at least one further hook portion formed on said elongate member spaced along the length thereof from said first hook portion, said first hook portion and the or each of said at least one further hook portions facing in the same axial direction and extending in radially different directions from the axis of the elongate member such that upon mounting said flexible member said hooks may be oriented about an axis corresponding to the axis of the elongate member to place a selected one of said hook portions in a cooperative position with regard to said stop body whereby relative movement of said two parts causes said selected one of said hook portions to engage said stop body to prevent relative movement of said two parts by an amount more than that determined by the selected hooked element.

2. The catch means as claimed in claim 1, in which said elongate flexible member extends from said mounting end thereof at an angle diverging from the normal to the piece of furniture when it is mounted thereon.

3. The catch means as claimed in claim 1, in which the hooked element has two hook portions.

4. The catch means as claimed in claim 3, in which said two hook portions are located respectively on opposite sides of the elongate flexible member.

5. The catch means as claimed in claim 4, in which that portion of said elongate flexible member running from said mounting end to the first hooked portion extends at an angle diverging from the normal to the piece of furniture when the member is mounted thereon, thereafter the elongate member extending at an angle diverging from the axis of said first portion thereof.

6. Catch means as claimed in claim 5, in which the surface of the stop body and the surfaces of the hook portions with which they engage in use are serrated, and in which said stop body and hooked element are formed by moulding nylon.

7. The catch means as claimed in claim 1, in which said hooked element comprises an elongate flexible member having four hook portions formed thereon, said four hook portions being located equispaced along the length of and around the elongate flexible member.

8. The catch means as claimed in claim 1, in which the surface of the stop body and the surfaces of the hook portions with which they engage in use are roughened.

9. The catch means as claimed in claim 8, in which said roughened surfaces are serrated.

10. The catch means as claimed in claim 1, in which said stop body and hooked element are formed by moulding a plastics material.

11. Catch means as claimed in claim 10, in which said stop body and hooked member are of nylon.

* * * * *